United States Patent [19]

Gardam

[11] Patent Number: 4,791,853

[45] Date of Patent: Dec. 20, 1988

[54] WEAPON AIMING SYSTEM FOR USE IN A TANK

[75] Inventor: Allan Gardam, Newburgh, United Kingdom

[73] Assignee: Pilkington P.E. Limited, United Kingdom

[21] Appl. No.: 129,639

[22] Filed: Dec. 7, 1987

[30] Foreign Application Priority Data

Dec. 12, 1986 [GB] United Kingdom ..... 8629747

[51] Int. Cl.[4] ..... F41G 3/16

[52] U.S. Cl. ..... 89/41.19; 89/41.06; 33/237

[58] Field of Search ..... 89/41.06, 41.17, 41.19, 89/41.21, 41.22; 33/237, 245

[56] References Cited

U.S. PATENT DOCUMENTS

| | | | |
|---|---|---|---|
| 1,316,401 | 9/1919 | van den Beld . | |
| 1,531,132 | 3/1925 | Radford . | |
| 2,466,725 | 4/1949 | Minter | 33/237 |
| 3,545,837 | 12/1970 | Chapman . | |
| 4,275,639 | 6/1981 | Garber . | |

FOREIGN PATENT DOCUMENTS

| | | | |
|---|---|---|---|
| 0173406 | 3/1986 | European Pat. Off. | 89/41.06 |
| 3231026A1 | 8/1982 | Fed. Rep. of Germany . | |
| 1234832 | 10/1960 | France | 89/41.19 |
| 1205369 | 7/1969 | United Kingdom . | |
| 2072810 | 10/1981 | United Kingdom | 89/41.19 |

*Primary Examiner*—Stephen C. Bentley
*Assistant Examiner*—Stephen Johnson
*Attorney, Agent, or Firm*—F. Eugene Davis, IV

[57] ABSTRACT

The invention is concerned with a weapon aiming system for use in a fire control system such as those used in a military tank. The aiming system includes a linkage which connects a mirror with an angularly movable weapon (a gun). Upon angular movement of the gun its movement is transferred through the linkage to the mirror. The ratio of angular movement imparted between the weapon and the mirror is 2:1. Two exemplary embodiments are described and in each the linkage includes two parallelogram linkage sets each set comprising a connecting link joining two parallel arms. The system also includes a slider crank positioned in the system to form a first side of a variable triangle of links in the system. The second side of the variable triangle is formed by one parallel arm of one of the parallelogram linkage sets and the third side is formed by at least part of the connecting link.

10 Claims, 2 Drawing Sheets

WEAPON AIMING SYSTEM FOR USE IN A TANK

BACKGROUND OF THE INVENTION

This invention relates to weapon aiming systems such as those used in the fire control system of a military tank.

In a conventional optical aiming system for use with a weapon which is angularly moveable, typically in elevation, there is usually a requirement for the optical relay to the gunner to be positioned remote from the bore-line of the weapon. For example, if the weapon is the gun of a tank, the weapon is usually mounted in the turret, which is itself swivelable in the azimuth plane, the gun also being elevatable. To aim the weapon an optical sighting system is used in which a swivelable mirror is mounted outside the armour level of the turret above the gun and sometimes also to one side of it. The mirror is of necessity required to be rotated at half of the angular velocity of the weapon itself, i.e. the ratio of angular movement between the weapon and the mirror is 2:1.

Known mechanisms for producing such a 2:1 ratio of movement between the weapon and the mirror are usually fairly complicated, in view of the extreme accuracy required, where tolerances of less than about one milliradian are the norm. Examples of such types of mechanism in conventional use utilise in one case a pully and belt drive arrangement and in another case an arrangement which uses a slider crank in conjunction with a slider block. However known conventional arrangements are generally very complicated and/or bulky and are often prone to causing inaccuracies in the sighting system unless they are regularly serviced and adjustments carried out as necessary. The present invention seeks to provide an alternative aiming system which uses a small number of parts but yet still provides a required 2:1 ratio of angular movement between the weapon and the mirror. The invention also seeks as an additional object to provide a weapon aiming system which is particularly compact and can, in suitable circumstances, even be retro-fitted to existing systems.

SUMMARY OF THE INVENTION

According to the invention, there is provided an aiming system for an angularly movably mounted weapon such as the gun of a military tank, the system comprising, a movable mirror for tracking the line of the weapon, a linkage connecting the mirror with the weapon and being adapted for transfer of movement between the weapon and the mirror and including at least two parallelogram linkage sets each set comprising a connecting link joining two parallel arms, and a slider crank positioned in the system and forming a first side of a variable triangle of links in the system, the second side of which variable triangle being formed by one parallel arm of said two parallel arms of one of said two parallelogram linkage sets, the third side of which variable triangle being formed by at least part of the connecting link joining said one parallel arm with the other parallel arm of said one parallelogram linkage set, wherein upon angular movement of the weapon, the ratio of angular movement imparted through the linkage between the weapon and the mirror is 2:1. The provision of a variable triangle of links in the system as specified essentially utilises the principle wherein a rectangular four bar chain in which each link thereof is of equal length has the property that either diagonal of the rectangular four bar chain rotates at half the speed of the link rotation. The use of this principle in the present invention therefore neatly and simply solves the problem of how to transfer movement from the weapon to the mirror at the required ratio of movement of 2:1.

Conveniently, the mirror may be or form part of an optical sight forming part of the aiming system, which optical sight is in modular form so that it can be easily removed, serviced and replaced into the aiming system. The invention, in one form, may therefore provide for the optical sight to include within it the variable triangle of links referred to, i.e. the slider crank, one arm of one of the parallelogram linkage sets and at least part of the link between that arm and its corresponding arm of the same set. In this embodiment of the invention, it therefore follows that the optical sight of the aiming system, if in modular form, can be provided with a single input shaft from the remainder of the linkages to the weapon itself.

Alternatively, the variable triangle of links in the system may be disposed essentially remote from the optical sight, if the sight is in modular form, which can therefore facilitate easy access thereto for ease of adjustment and/or servicing.

The invention will now be described, by way of example only, with reference to the accompanying drawings in which:

DESCRIPTION OF THE PREFERRED EMBODIMENT

Figure 1:
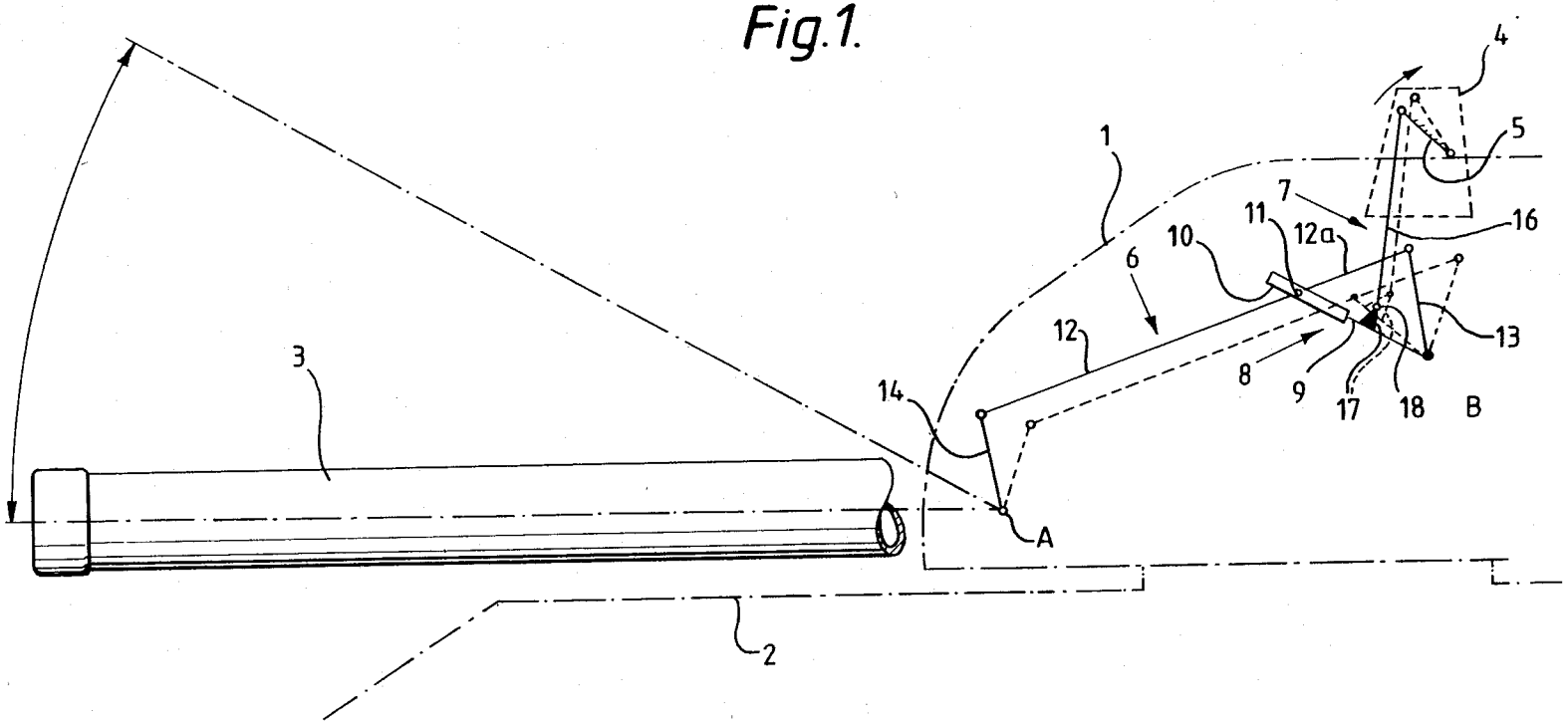
FIG. 1 is a schematic sectional elevation of part of a military tank incorporating one form of the invention.

Referring firstly to FIG. 1 of the drawings there is shown in outline the form of part of a military tank, comprising a turret 1 mounted for rotation in the azimuth plane on a tank body 2. A weapon in the form of a gun 3 is swivelably mounted on the turret 1 about a pivot axis "A" such that the gun 3 can elevate in the direction shown arrowed as required.

An optical aiming sight 4 (shown in dotted outline) is secured part within and part without the turret 1 and includes within it a mirror 5 for directing light rays from the outside world into the optical aiming sight 4 for subsequent relay to a viewer thereof, e.g. the tank gunner via a lens system and aiming graticule (not shown.

The mirror 5 is elevatable in synchromism with the gun 3 (as indicated in outline) but at only half of the angular velocity of the gun 3.

The mirror 5 is connected to the gun 3 for swivelling movement by means of a pair of parallelogram linkage sets 6,7 which are connected to each other via a variable triangle of links 8. The variable triangle of links has a first side formed by a slider crank 9, which incorporates a crank guide 10 within which is slideably received a crank slider 11 fixed to a elongate connecting link 12 of the parallelogram linkage set 6. The second side of the variable triangle of links 8 comprises an arm 13 of the parallelogram linkage set 6, the other arm 14 thereof being connected to the link 12 and being fixed to one end of the gun 3 to pivot about point "A".

The third side of the variable triangle of links 8 is formed by that part 12*a* of the connecting link 12 between the crank slider 1 and the end of the arm 13 remote from the slider crank 9. The second and third sides of the triangle 8 are of equal length whereas, as will be apparent, during movement of the linkage system comprising the two parallelogram linkage sets 6 and 7 and the variable triangle of links 8, the slider crank 9 is effectively of variable length.

The slider crank 9 and arm 13 both pivot about a fixed point "B" within the turret 1.

The parallelogram linkage set 7 has an elongate connecting link 16, each end of which is pivotally connected to a respective arm. For convenience of illustration only, one of these arms is shown constituted by the mirror 5 although, clearly, the mirror 5 may be simply connected to a rigid but pivotally mounted connecting link such as those identified as the arms 13 and 14 of the parallelogram linkage set 6. The other of the arms of the parallelogram linkage set 7 is constituted essentially by part of the slider crank 9. A triangular plate 17 is fixed to the slider crank 9 and is provided with a pivot pin 18 by which it is connected to the connecting link 16. The straight line distance between the pivot pin 18 on the triangular plate 17 and the pivot point "B" lies parallel with the plane of the mirror 5, thus constituting in effect the parallelogram linkage set 7.

In operation, it will be apparent that elevation of the gun 3 causes rotation about the axis "A" of the arm 14 of the parallelogram linkage set 6. This in turn causes the crank slider 11 to move relatively within the crank guide 10, thus transferring movement from the parallelogram linkage set 6 to the parallelogram linkage set 7 via the pivot pin 18 on the triangular plate 17. Because the first side of the variable triangle of links 8 is constituted by part of the effective length of the slider crank 9 and because the remaining sides of the triangle are of constant fixed length with respect to each other it will be apparent that rotation of the arm 13 about the pivot axis "B" occurs at twice the speed of rotation in the same direction of the first side of the triangle 8. As a consequence, the ratio of angular movement transmitted from the gun 3 to the mirror 5 is 2:1.

It will be apparent from the drawing that only one input shaft (the connecting link 16) is therefore needed to the optical sight 4 and this has the advantages previously discussed.

Figure 2:
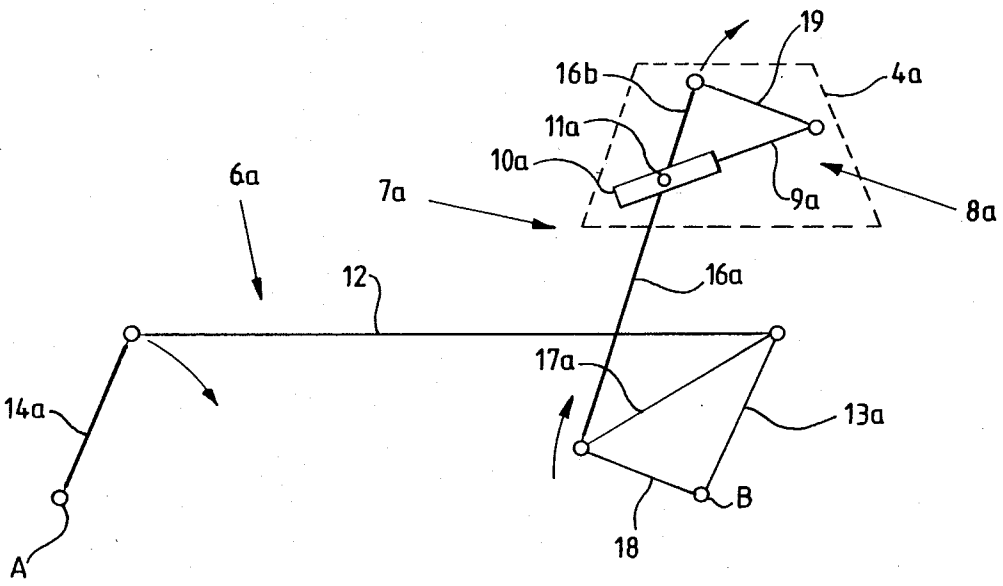
FIG. 2 is an enlarged schematic elevation showing the principle of operation of a alternative form of the invention to that shown in FIG. 1.

Referring now to FIG. 2 of the drawings, a basically similar arrangement is shown to that of FIG. 1. The only major difference in the arrangement shown in FIG. 2 to that of FIG. 1 is in the position of the variable triangle of links 8*a*. In this case, it will be seen that the arm 13*a* of the first parallelogram linkage set 6*a* is rigidly connected to the arm 18 of the second parallelogram linkage set 7*a* by means of a triangular plate 17*a*. Thus, in this arrangement angular rotation of the arms 13*a* and 14*a* transmits a one to one rotation to the corresponding arms 18, 19, in the second parallelogram linkage set 7*a*. However, once again there is a triangle of links 8*a* comprising a slider crank 9*a* the arm 19 and that part 16*b* of the connecting link 16*a* between the crank slider 11*a* and the end of the arm 19 remote from the end connected to the slider crank 9*a*. In this arrangement, it will be apparent that the ratio of angular movement between the slider crank 9*a* itself and the two parallelogram linkage sets 6*a*,7*a* is 2:1 and accordingly, a mirror fixed to any part of the slider crank 9*a* will move at only half of the angular speed of the weapon to which the linkage system is attached. As with the embodiment of the invention described with reference to FIG. 1, the second embodiment of FIG. 2 again only requires a single input shaft (16*a*) to the optical aiming sight 4*a*. However, whereas in the first embodiment the triangle of links are disposed outside the body of the sight 4 so as to be readily accessible for servicing or adjustment, in the second embodiment the triangle of links is positioned within the body of the sight. This is a useful feature in certain circumstances in that the entire mechanism can be part of a single sealed unit.

What is claimed is:

1. An aiming system for an angularly movably mounted weapon, the system comprising in combination;

a movable mirror for tracking the line of the weapon;

a linkage connecting the mirror with the weapon, the linkage being effective to transfer movement between the weapon and the mirror;

at least two parallelogram linkage sets included in the linkage, each set comprising a connecting link joining two parallel arms; and a slider crank positioned in the system and forming a first side of a variable triangle of links in the system, the second side of which variable triangle being formed by one parallel arm of said two parallel arms of one of said two parallelogram linkage sets, the third side of which variable triangle being formed by at least part of the connecting link joining said one parallel arm with the other parallel arm of said one parallelogram linkage set;

wherein upon angular movement of the weapon, the ratio of angular movement imparted through the linkage between the weapon and the mirror is 2:1.

2. A system as claimed in claim 1, wherein the mirror forms part of an optical sight forming part of the aiming system.

3. A system as claimed in claim 2, wherein the optical sight is in modular form.

4. A system as claimed in claim 3, in which the optical sight is provided with a single input shaft for the transfer of movement from the weapon to the mirror.

5. A system as claimed in claim 4, wherein the optical sight includes said variable triangle of links.

6. A system as claimed in claim 4, wherein the variable triangle of links is located remote from the optical sight.

7. A system as claimed in claim 5, wherein the single input shaft is constituted by the connecting link of said one parallelogram linkage set.

8. A system as claimed in claim 7, wherein said one parallelogram linkage set is connected with the other parallelogram linkage set of said two parallelogram linkage sets which is connected with the weapon.

9. A system as claimed in claim 6, wherein the single input shaft is constituted by the connecting link of the other parallelogram linkage set of said two parallelogram linkage sets.

10. A system as claimed in claim 9, wherein said other parallelogram linkage set is connected with said one parallelogram linkage set which is connected with the weapon.

* * * * *